US011649575B2

(12) United States Patent
Kongo et al.

(10) Patent No.: US 11,649,575 B2
(45) **Date of Patent: *May 16, 2023**

(54) COORDINATE DATA CREATING DEVICE AND SEWING MACHINE

(71) Applicant: JANOME SEWING MACHINE CO., LTD., Hachioji (JP)

(72) Inventors: Takeshi Kongo, Hachioji (JP); Hiromi Oda, Hachioji (JP)

(73) Assignee: JANOME SEWING MACHINE CO., LTD., Hachioji (JP)

( * ) Notice: Subject to any disclaimer, the term of this patent is extended or adjusted under 35 U.S.C. 154(b) by 230 days.

This patent is subject to a terminal disclaimer.

(21) Appl. No.: 17/156,632

(22) Filed: Jan. 25, 2021

(65) Prior Publication Data

US 2021/0285139 A1 Sep. 16, 2021

(30) Foreign Application Priority Data

Mar. 13, 2020 (JP) ..... JP2020-043797

(51) Int. Cl.
*D05B 19/08* (2006.01)
*D05B 19/10* (2006.01)

(52) U.S. Cl.
CPC ..... *D05B 19/08* (2013.01); *D05B 19/10* (2013.01)

(58) Field of Classification Search
CPC ..... D05B 19/08; D05B 19/10; D05B 19/14
See application file for complete search history.

(56) References Cited

U.S. PATENT DOCUMENTS

| | | | | |
|---|---|---|---|---|
| 6,161,491 | A * | 12/2000 | Takenoya | D05B 79/00 112/456 |
| 10,876,238 | B2 * | 12/2020 | Kongo | D05C 9/06 |
| 10,995,437 | B2 * | 5/2021 | Kongo | G06F 3/13 |
| 2009/0050038 | A1 | 2/2009 | Ishii et al. | |
| 2020/0010990 | A1 | 1/2020 | Kongo | |

FOREIGN PATENT DOCUMENTS

| | | | |
|---|---|---|---|
| JP | 2852967 | B | 2/1999 |
| JP | 2009-45262 | A | 3/2009 |
| JP | 2011-245092 | A | 12/2011 |
| JP | 2020-5797 | A | 1/2020 |

* cited by examiner

*Primary Examiner* — Tajash D Patel
(74) *Attorney, Agent, or Firm* — Yokoi & Co., U.S.A.; Toshiyuki Yokoi

(57) ABSTRACT

The desired seams are formed while adding a hand-sewn taste to the sewing pattern without changing the tendency of the hand-sewn taste for the same pattern. A coordinate data storage unit for storing coordinate data which indicates a needle location of a pattern to be sewn, an addition value storage unit for storing an addition value which is added to each of the coordinate data, and an adjustment unit for adjusting the coordinate data or the addition value; and an added coordinate data creating unit for creating a new coordinate data where the pattern is deformed by adding the addition value adjusted by the adjustment unit to the coordinate data or by adding the addition value to the coordinate data adjusted by the adjustment unit or by adding the addition value adjusted by adjustment unit to the coordinate data adjusted by the adjustment unit are provided.

4 Claims, 15 Drawing Sheets

Fig. 6

| | original data | | | adjustment length of addition value | | hand-sewn process (strong fluctuation) | | |
|---|---|---|---|---|---|---|---|---|
| stitch No. | amplitude | relative feeding | absolute feeding | for amplitude | for feeding | amplitude | absolute feeding | relative feeding |
| 1 | 4.4 | 2.3 | 0.0 | 0.2 | 0.0 | 4.4 | 0.0 | 2.7 |
| 2 | 4.4 | 2.4 | 2.3 | 0.1 | 0.4 | 4.4 | 2.7 | 1.8 |
| 3 | 4.4 | 2.3 | 4.7 | −0.6 | −0.2 | 3.8 | 4.5 | 2.7 |
| 4 | 4.4 | 0.0 | 7.0 | −0.6 | 0.2 | 3.8 | 7.2 | 0.0 |
| 5 | 0.8 | 0.0 | 7.0 | 0.2 | 0.2 | 1.0 | 7.2 | −0.5 |
| 6 | −2.4 | −1.7 | 7.0 | 0.4 | −0.3 | −2.0 | 6.7 | −1.2 |
| 7 | −2.4 | −1.8 | 5.3 | 0.0 | 0.2 | −2.4 | 5.5 | −2.0 |
| 8 | −2.4 | 0.0 | 3.5 | 0.6 | 0.0 | −1.8 | 3.5 | 0.3 |
| 9 | 0.0 | 1.7 | 3.5 | −0.2 | 0.3 | −0.2 | 3.8 | 1.0 |
| 10 | 0.0 | 0.0 | 5.2 | 0.4 | −0.4 | 0.4 | 4.8 | 0.5 |
| 11 | 2.4 | −3.2 | 5.2 | 0.4 | 0.1 | 2.8 | 5.3 | −3.3 |
| 12 | 2.4 | 0.0 | 2.0 | −0.4 | 0.0 | 2.0 | 2.0 | 0.0 |
| 13 | −1.2 | 0.0 | 2.0 | −0.2 | 0.0 | −1.4 | 2.0 | 0.0 |
| 14 | −4.4 | 2.5 | 2.0 | 0.6 | 0.0 | −3.8 | 2.0 | 2.2 |
| 15 | −4.4 | 2.3 | 4.5 | 0.0 | −0.3 | −4.4 | 4.2 | 3.0 |
| 16 | −4.4 | 2.4 | 6.8 | −0.4 | 0.4 | −4.4 | 7.2 | 1.5 |
| 17 | −4.4 | 0.0 | 9.2 | −0.1 | −0.5 | −4.4 | 8.7 | 0.1 |
| 18 | 0.0 | 0.0 | 9.2 | −0.4 | −0.4 | −0.4 | 8.8 | 0.4 |
| 19 | 4.4 | 0.0 | 9.2 | 0.0 | 0.0 | 4.4 | 9.2 | |

Fig. 8

| | original data | | | adjustment length of addition value | | hand-sewn process (weak fluctuation) | | |
|---|---|---|---|---|---|---|---|---|
| stitch No. | amplitude | relative feeding | absolute feeding | for amplitude | for feeding | amplitude | absolute feeding | relative feeding |
| 1 | 4.4 | 2.3 | 0.0 | 0.1 | 0.0 | 4.4 | 0.0 | 2.5 |
| 2 | 4.4 | 2.4 | 2.3 | 0.1 | 0.2 | 4.4 | 2.5 | 2.1 |
| 3 | 4.4 | 2.3 | 4.7 | −0.3 | −0.1 | 4.1 | 4.6 | 2.5 |
| 4 | 4.4 | 0.0 | 7.0 | −0.3 | 0.1 | 4.1 | 7.1 | 0.0 |
| 5 | 0.8 | 0.0 | 7.0 | 0.1 | 0.1 | 0.9 | 7.1 | −0.3 |
| 6 | −2.4 | −1.7 | 7.0 | 0.2 | −0.2 | −2.2 | 6.8 | −1.4 |
| 7 | −2.4 | −1.8 | 5.3 | 0.0 | 0.1 | −2.4 | 5.4 | −1.9 |
| 8 | −2.4 | 0.0 | 3.5 | 0.3 | 0.0 | −2.1 | 3.5 | 0.2 |
| 9 | 0.0 | 1.7 | 3.5 | −0.1 | 0.2 | −0.1 | 3.7 | 1.3 |
| 10 | 0.0 | 0.0 | 5.2 | 0.2 | −0.2 | 0.2 | 5.0 | 0.3 |
| 11 | 2.4 | −3.2 | 5.2 | 0.2 | 0.1 | 2.6 | 5.3 | −3.3 |
| 12 | 2.4 | 0.0 | 2.0 | −0.2 | 0.0 | 2.2 | 2.0 | 0.0 |
| 13 | −1.2 | 0.0 | 2.0 | −0.1 | 0.0 | −1.3 | 2.0 | 0.0 |
| 14 | −4.4 | 2.5 | 2.0 | 0.3 | 0.0 | −4.1 | 2.0 | 2.3 |
| 15 | −4.4 | 2.3 | 4.5 | 0.0 | −0.2 | −4.4 | 4.3 | 2.7 |
| 16 | −4.4 | 2.4 | 6.8 | −0.2 | 0.2 | −4.4 | 7.0 | 1.9 |
| 17 | −4.4 | 0.0 | 9.2 | −0.1 | −0.3 | −4.4 | 8.9 | 0.1 |
| 18 | 0.0 | 0.0 | 9.2 | −0.2 | −0.2 | −0.2 | 9.0 | 0.2 |
| 19 | 4.4 | 0.0 | 9.2 | 0.0 | 0.0 | 4.4 | 9.2 | |

Fig. 11

| | original data | | | adjustment length of addition value | | hand-sewn process (strong fluctuation) | | |
|---|---|---|---|---|---|---|---|---|
| stitch No. | amplitude | relative feeding | absolute feeding | for amplitude | for feeding | amplitude | absolute feeding | relative feeding |
| 1 | 0.0 | 0.0 | 0.0 | −0.6 | 0.0 | −0.6 | 0.0 | 2.5 |
| 2 | 0.0 | 3.0 | 3.0 | 1.2 | −0.5 | 1.2 | 2.5 | 3.7 |
| 3 | 0.0 | 3.0 | 6.0 | −1.2 | 0.2 | −1.2 | 6.2 | −3.2 |
| 4 | −4.4 | −2.5 | 3.5 | 0.6 | −0.5 | −3.8 | 3.0 | 3.2 |
| 5 | 0.0 | 2.5 | 6.0 | −1.2 | 0.2 | −1.2 | 6.2 | −1.7 |
| 6 | 4.4 | −2.5 | 3.5 | −1.0 | 1.0 | 3.4 | 4.5 | 1.7 |
| 7 | 0.0 | 2.5 | 6.0 | −1.2 | 0.2 | −1.2 | 6.2 | |

Fig. 14

| | original data | | | adjustment length of addition value | | hand-sewn process (strong fluctuation) | | |
|---|---|---|---|---|---|---|---|---|
| stitch No. | amplitude | relative feeding | absolute feeding | for amplitude | for feeding | amplitude | absolute feeding | relative feeding |
| 1 | 0.0 | 0.0 | 0.0 | −0.3 | 0.0 | −0.3 | 0.0 | 2.5 |
| 2 | 0.0 | 3.0 | 3.0 | 0.6 | −0.5 | 0.6 | 2.5 | 3.7 |
| 3 | 0.0 | 3.0 | 6.0 | −0.6 | 0.2 | −0.6 | 6.2 | −3.2 |
| 4 | −2.2 | −2.5 | 3.5 | 0.3 | −0.5 | −1.9 | 3.0 | 3.2 |
| 5 | 0.0 | 2.5 | 6.0 | −0.6 | 0.2 | −0.6 | 6.2 | −1.7 |
| 6 | 2.2 | −2.5 | 3.5 | −0.5 | 1.0 | 1.7 | 4.5 | 1.7 |
| 7 | 0.0 | 2.5 | 6.0 | −0.6 | 0.2 | −0.6 | 6.2 | |

| | original data | | | adjustment length of addition value | | hand-sewn process (strong fluctuation) | | |
|---|---|---|---|---|---|---|---|---|
| stitch No. | amplitude | relative feeding | absolute feeding | for amplitude | for feeding | amplitude | absolute feeding | relative feeding |
| 1 | 0.0 | 0.0 | 0.0 | -0.6 | 0.0 | -0.6 | 0.0 | 2.5 |
| 2 | 0.0 | 3.0 | 3.0 | 1.2 | -0.5 | 1.2 | 2.5 | 3.7 |
| 3 | 0.0 | 3.0 | 6.0 | -1.2 | 0.2 | -1.2 | 6.2 | -3.2 |
| 4 | -2.2 | -2.5 | 3.5 | 0.6 | -0.5 | -1.6 | 3.0 | 3.2 |
| 5 | 0.0 | 2.5 | 6.0 | -1.2 | 0.2 | -1.2 | 6.2 | -1.7 |
| 6 | 2.2 | -2.5 | 3.5 | -1.0 | 1.0 | 1.2 | 4.5 | 1.7 |
| 7 | 0.0 | 2.5 | 6.0 | -1.2 | 0.2 | -1.2 | 6.2 | |

COORDINATE DATA CREATING DEVICE AND SEWING MACHINE

CROSS-REFERENCES TO RELATED APPLICATIONS

This patent specification is based on Japanese patent application, No. 2020-43797 filed on Mar. 13, 2020 in the Japan Patent Office, the entire contents of which are incorporated by reference herein.

BACKGROUND OF THE INVENTION

1. Field of the Invention

The present invention relates to a coordinate data creating device and a sewing machine.

2. Description of the Related Art

In general, the position of seams of a sewing machine is determined by an amplitude position of a needle and a feeding amount of a fabric. Thus, a pattern is formed by connecting needle location points with each other by threads.

Here, when forming the pattern, the data is inputted by determining the position of the needle to be lowered one by one for each stitch based on the drawing to be sewn.

Namely, the sewing data is basically created for faithfully reproducing the seams of the original drawing in many cases.

Thus, the original drawing can be drawn by the seams by connecting the needle location points in straight lines or curved lines in accordance with the sewing data.

Therefore, the pattern can be faithfully reproduced by anyone by using the sewing machine, and good-looking pattern can be formed on the fabric as if the pattern is sewn by an expert. However, on the contrary, the above described fact gives mechanical and cool impression.

For the above described problem, the technology of calculating the control amount of the seams of the sewing machine while regarding the fluctuation of the control amount of the seams as 1/f fluctuation and driving a feed control motor and an amplitude control motor while adding the elements of the fluctuation is disclosed (e.g., shown in Patent Document 1).

In addition, the technology of controlling the adjustment amount of the amplitude and feeding for each cycle without adjusting them by the fluctuation in the midway of the pattern to avoid collapsing the pattern remarkably is also disclosed (e.g., shown in Patent Document 2).

In addition, the technology of forming the seams by adding small vector data to each of the needle location points to slightly shift the original positon without faithfully reproducing the pattern so that the seams appear to be hand sewn (e.g., shown in Patent Document 3).

[Patent Document 1] Japanese Patent No. 2852967

[Patent Document 2] Japanese Unexamined Patent Application Publication No. 2011-245092

[Patent Document 3] Japanese Unexamined Patent Application Publication No. 2020-5797

BRIEF SUMMARY OF THE INVENTION

However, the technology described in Patent document 1 has the problem that the sewn pattern is excessively deformed since the elements of the fluctuation are controlled to be added to each stitch.

In particular, a feeding direction is strongly influenced since the feeding direction is a relative moving amount. Thus, the pattern may be deformed significantly such that the original design cannot be recognized.

Furthermore, in the technology described in Patent document 2, when the number of needles included in one cycle is large, the width of the pattern or the length of the pattern is merely changed for each cycle without adding the fluctuation for each stitch. Thus, the change of the pattern is mechanical. Accordingly, even if cool impression can be avoided, the pattern never gives warm impression.

Furthermore, in the technology described in Patent document 3, a small vector is generated by values such as a random number and the small vector is changed each time when the pattern is selected to avoid the same pattern. However, since the small vector generated by the random number is changed each time when the intensity of fluctuation and the adjustment value of amplitude and feeding are changed for the selected pattern, the shape may be changed into a different shape separating from the prediction (desire) of a user. Thus, the improvement is required.

The present invention provides a coordinate data creating device and a sewing machine capable of forming the desired seams while adding hand-sewn taste to the sewing pattern without changing the tendency of the hand-sewn taste for the same pattern.

Embodiment 1: One or more embodiments of the present invention proposes a coordinate data creating device having: a coordinate data storage unit for storing coordinate data which indicates a needle location of a pattern to be sewn; an addition value storage unit for storing an addition value which is added to each of the coordinate data; an adjustment unit for adjusting the coordinate data or the addition value; and an added coordinate data creating unit for creating a new coordinate data where the pattern is deformed by adding the addition value adjusted by the adjustment unit to the coordinate data or by adding the addition value to the coordinate data adjusted by the adjustment unit or by adding the addition value adjusted by adjustment unit to the coordinate data adjusted by the adjustment unit.

Embodiment 2: One or more embodiments of the present invention proposes the coordinate data creating device having an adjusted data storage unit for storing the coordinate data or the addition data adjusted by the adjustment unit.

Embodiment 3: One or more embodiments of the present invention proposes the coordinate data creating device wherein the coordinate data has an amplitude direction value and a feeding direction value, and when the amplitude direction value or the feeding direction value of the new coordinate data exceeds a predetermined range, the amplitude direction value exceeding the predetermined range or the feeding direction value exceeding the predetermined range is not employed as the new coordinate data.

Embodiment 4: One or more embodiments of the present invention proposes a sewing machine having a coordinate data storage unit for storing coordinate data which indicates a needle location of a pattern to be sewn; an addition value storage unit for storing an addition value which is added to each of the coordinate data; an adjustment unit for adjusting the coordinate data or the addition value; and an added coordinate data creating unit for creating a new coordinate data where the pattern is deformed by adding the addition value adjusted by the adjustment unit to the coordinate data or by adding the addition value to the coordinate data adjusted by the adjustment unit or by adding the addition value adjusted by adjustment unit to the coordinate data adjusted by the adjustment unit, wherein the sewing machine performs a sewing based on the new coordinate data created by the added coordinate data creating unit.

One or more embodiments of the present invention has an effect that enables to form the desired seams while adding hand-sewn taste to the sewing pattern without changing the tendency of the hand-sewn taste for the same pattern.

Furthermore, when a pattern is newly selected, a new addition value including random value is generated and different fluctuation is added to the pattern. When the intensity of fluctuation and the adjustment value of amplitude and feeding are finely adjusted, a previously used addition value including random value is used again. Thus, the effect capable of changing the fluctuation within the same tendency can be expected.

BRIEF DESCRIPTION OF THE DRAWINGS

FIG. 6 is a drawing illustrating an original data and an addition value when strong fluctuation is added to the sewing image shown in FIG. 5 in a simple stitch concerning the first example of the present invention.

FIG. 8 is a drawing illustrating an original data and an addition value when weak fluctuation is added to the sawn image shown in FIG. 5 in a simple stitch concerning the first example of the present invention.

FIG. 11 is a drawing illustrating an original data and an addition value when strong fluctuation is added to the sewing image shown in FIG. 10 in a simple stitch concerning the second example of the present invention.

FIG. 14 is a drawing illustrating an original data and an addition value when the amplitude is changed in the sawn image shown in FIG. 12 in a simple stitch concerning the second example of the present invention.

DETAILED DESCRIPTION OF THE INVENTION

Embodiments

Hereafter, the embodiments of the present invention will be explained with reference to FIG. 1 to FIG. 4.

<Electrical configuration of coordinate data creating device>

An electrical configuration of a coordinate data creating device 10 concerning the present embodiment will be explained with reference to FIG. 1.

Figure 1:
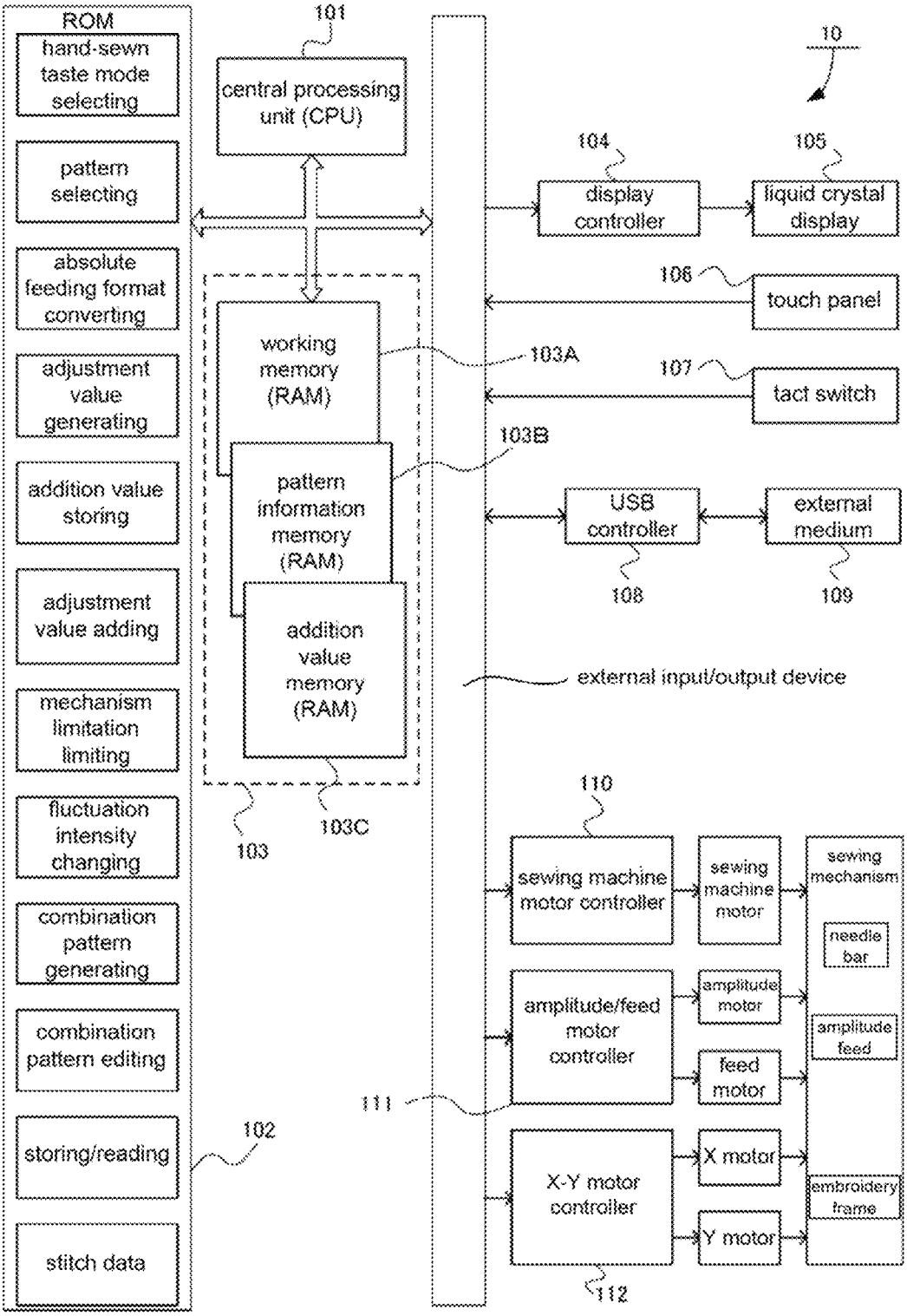
FIG. 1 is a block diagram showing an electrical configuration of a coordinate data creating device concerning an embodiment of the present invention.

As shown in FIG. 1, the coordinate data creating device 10 concerning the present embodiment is configured to include a central processing unit (CPU) 101, a ROM 102, a working memory (RAM) 103A, a pattern information memory (RAM) 103B, an addition value memory (RAM) 103C, a display controller 104, a liquid crystal display 105, a touch panel 106, a tact switch 107, a USB controller 108, an external medium 109, a sewing machine motor controller 110, an amplitude/feed motor controller 111 and an X-Y motor controller 112.

The central processing unit (CPU) 101 controls the operations of the entire coordinate data creating device 10 in accordance with control programs stored in the ROM 102.

In addition, the central processing unit (CPU) 101 is connected with various devices via an external input/output device.

The ROM 102 is a storage element for storing control programs, functional modules, stitch data, and the like.

For example, the ROM 102 stores various functional modules and data such as a hand-sewn taste mode selecting module, a pattern selecting module, an absolute feeding format converting module, an adjustment value generating module, an addition value storing module, an adjustment value adding module, a mechanism limitation limiting module, a fluctuation intensity changing module, a combination pattern generating module, a combination pattern editing module, a storing/reading module and a stitch data storing area.

The RAM 103 stores various information such as the pattern information and the addition value including random value and functions as a storage element for temporarily storing information in processes of the central processing unit (CPU) 101.

In the present embodiment, in the processes of the central processing unit (CPU) 101, a working memory (RAM) 103A for temporarily storing information, a pattern information memory (RAM) 103B for storing the pattern information, and an addition value memory (RAM) 103C which functions as an addition value storage unit for storing the addition value including random value are provided, for example.

Note that the pattern information memory (RAM) 103B also functions as the coordinate data storage unit and the adjusted data storage unit for storing the coordinate data indicating the needle location of the pattern to be sewn and storing the data including the coordinate data or the addition value adjusted by the adjustment unit which functions as the adjustment value generating module.

In addition, the addition value storing module preliminarily stores various addition values including random value used in an addition processing in the adjustment value adding module, for example. The addition value memory (RAM) 103C which functions as the addition value storage unit stores the addition values including random value used for each sewing pattern sewn based on the coordinate data created by the coordinate data creating device 10 of the present embodiment in a state that the addition values are associated with each sewing pattern.

Here, the addition values include not only random value but also arbitrary sequence of numbers.

The display controller 104 controls to display the display data such as letters, patterns, buttons and the like transmitted from the central processing unit (CPU) 101 at a predetermined position in the display area of the later described liquid crystal display 105.

The liquid crystal display 105 has a multilayer structure where a touch panel is layered below a liquid crystal display surface. Thus, the touch panel and the liquid crystal display 105 are unitized as "display unit." In the present embodiment, the liquid crystal display 105 displays an operation screen shown in FIG. 2, for example.

The touch panel 106 is configured as a panel of a capacitance type, a resistive film type or the like. The touch panel 106 is electrically connected with the CPU 101 via the external input/output device.

In addition, the touch panel 106 is arranged to be exposed to the outside of the coordinate data creating device 10 so as to be operable by considering user's convenience.

The user can operate the touch panel 106 by touching the touch panel with fingers while checking the selection of a hand-sewn taste mode and the selection of the pattern on the screen.

Figure 2:
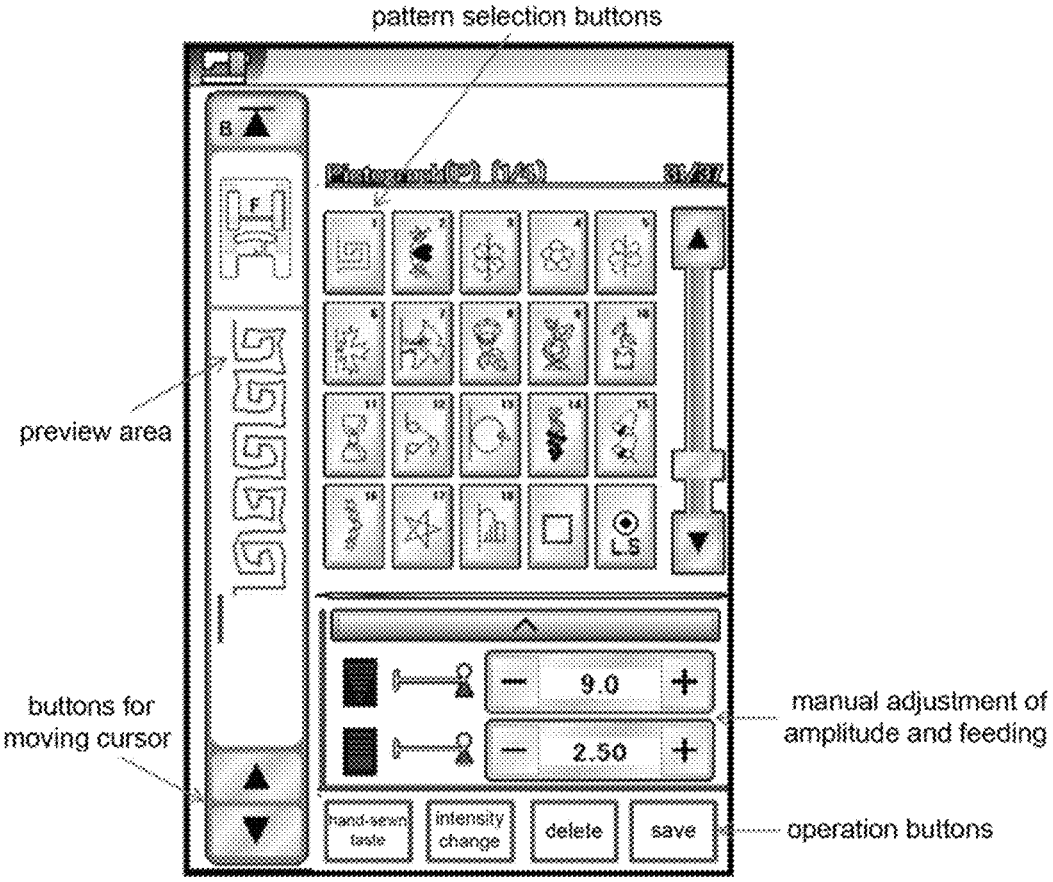
FIG. 2 is a drawing illustrating the operation screen operated in the coordinate data creating device concerning an embodiment of the present invention.

In the present embodiment, when the user presses "hand-sewn taste" button on the operation screen shown in FIG. 2, for example, the hand-sewn taste mode selecting module is enabled. Thus, the stitch data is finely adjusted by a hand-sewn taste stitch conversion function for the patterns selected after that.

Specifically, when "pattern selection" button is operated on the operation screen shown in FIG. 2, the pattern selecting module is enabled.

For example, when the button of No. 1 is pressed, the pattern of the pattern number 1 included in the ROM 102 of the coordinate data creating device 10 is selected and the stitch data for one cycle is read.

The tact switch 107 is electrically connected with the CPU 101 via the external input/output device.

In addition, the buttons for enabling the user to perform the operations such as start/stop of the sewing operation, thread cutting operation, threading operation and the like are arranged intensively on the tact switch 107.

When the above described buttons are pressed, the instructions of starting/stopping sewing, the vertical movement of the needle, the threading (not illustrated) can be transmitted to the central processing unit (CPU) 101.

The USB (Universal Serial Bus) controller 108 is configured to execute control for performing communication via the USB and built in a host (sewing machine) side.

The USB controller 108 connects the coordinate data creating device 10 with the external devices such as the external medium 109 and control them.

When the USB controller 108 is used, the information such as the addition value including random value and the fluctuation intensity stored in the addition value memory 103C which functions as the addition value storage unit can be written in the external medium 109 or the like, for example.

In addition, when the information written in the external medium 109 or the like is read again, even the pattern adjusted by the addition value including random value can be reproduced and redundantly sewn.

The external medium 109 is a hard disk, a DVD recorder or the like, for example. The external medium 109 writes and stores the pattern data or the like under the control of the USB controller 108.

The sewing machine motor controller 110 is electrically connected with the CPU 101 via the external input/output device. The sewing machine motor controller 110 controls to rotate a sewing machine motor according to the command transmitted from the CPU 101 to form the seams by the vertical movement of a needle bar.

The amplitude/feed motor controller 111 controls to drive an amplitude motor according to the command transmitted from the CPU 101 to swing the needle bar in a zigzag motion.

In addition, the amplitude/feed motor controller 111 controls to drive a feed motor to control the feeding amount or the forward and backward directions of the sewing object.

Namely, the sewing mechanism is controlled by the sewing machine motor, the amplitude motor and the feed motor to form the seams of a straight line, a zigzag line or a representational pattern. Hereafter, the sewing object includes objects such as cloth, leather and plastic (vinyl) which can be sewn.

The X-Y motor controller 112 is electrically connected with the CPU 101 via the external input/output device. The X-Y motor controller 112 controls to drive an X motor and/or a Y motor according to the command transmitted from the CPU 101 to move an embroidery frame of the sewing mechanism in the X-direction and/or the Y-direction.

The X-Y motor controller 112 determines the needle location points on the sewing object set to the embroidery frame by instructing the X-motor and/or the Y-motor. Thus, the seams of the embroidery are formed and the pattern is sewn by the vertical movement of the sewing machine motor controlled by the sewing machine motor controller 110.

When the central processing unit (CPU) 101 enables the absolute feeding format converting module, the stitch data indicated as the relative feeding amount is converted into the data format of the absolute coordinate obtained by accumulating the feeding amount.

Note that the details of the process will be explained later.

When the central processing unit (CPU) 101 enables the adjustment value generating module, the addition value including random value is generated as an integral value and the addition value including random value is converted into the unit of length with 0.1 millimeter unit.

Note that the details of the process will be explained later.

When the central processing unit (CPU) 101 enables the adjustment value adding module, the adjustment length adjusted by the addition value including random value is added to both the original amplitude value and the absolute feeding data.

However, when the calculation result exceeds the limit value of the mechanism, the mechanism limitation limiting module is enabled and the addition is not performed.

In addition, when the same coordinate exists on the original data, the already adjusted coordinate is used also for the same coordinate by the identical-point process so that the coordinate becomes identical also after the adjustment.

Note that the details of the process will be explained later.

When the central processing unit (CPU) 101 detects that the user presses the intensity change button shown in FIG. 2, the intensity of the fluctuation varies in the order of 100%, 75%, 50%, no fluctuation and 100%.

The needle location points are moved in each stitch by a minute distance by using the intensity selected by the user and the addition value including random value stored in the addition value memory 103C which functions as the addition value storage unit. Thus, the result of the fluctuation is displayed on a preview area.

When the process of the hand-sewn taste is applied to the data of one cycle, the central processing unit (CPU) 101 enables the combination pattern generating module and the generated combination pattern is temporarily stored in a working memory (RAM).

In addition, one cycle of the pattern converted into the hand-sewn taste is displayed on the preview area of the operation screen shown in FIG. 2.

When the same pattern is selected again, the pattern is finely adjusted by another addition value including random value and drawn on the preview screen as the second cycle.

When the central processing unit (CPU) 101 enables the combination pattern editing module, the deletion and addition of the pattern and the change of the combination are enabled, for example.

Note that the pattern is finely adjusted by another addition value including random value also when the pattern is added.

When the central processing unit (CPU) 101 enables the storing/reading module, the combined pattern can be written in the external medium 109 or the like.

Accordingly, even the pattern adjusted by the addition value including random value can be reproduced and redundantly sewn.

<Display and Function of Operation Screen>

The operation screen shown in FIG. 2 is configured to include a plurality of pattern buttons, a hand-sewn taste button for entering a hand-sewn taste mode, an intensity change button for selecting the intensity of the fluctuation, a delete button for canceling the selected pattern, a save button for storing the combined pattern, [+] and [−] buttons for manually adjusting the amplitude and the feeding, a preview area for displaying the combined pattern, and cursor buttons [▲], [▼] for selecting one cycle of the pattern displayed on the preview area.

<Processes Based Operation of Operation Screen>

First, the user presses the hand-sewn taste button to shift the mode to the combination mode of the hand-sewn taste. Then, when the user presses the pattern button, the stitch data stored in a built-in stitch data module shown in FIG. 1 is displayed on the liquid crystal display 105 as shown in FIG. 2.

The user selects the pattern from the stitch data displayed on the liquid crystal display 105 by a touch operation.

When the pattern is selected by the user, the coordinate data creating device 10 generates a new addition value including random value, and the adjustment value adjusted by the addition value including random value is added to the coordinate of the amplitude position and the coordinate of the feeding direction.

Thus, the coordinate data creating device 10 finely adjusts each of the needle location points, converts one cycle of the pattern into the hand-sewn taste, and displays it on the preview area.

When the user presses the same pattern button again, the coordinate data creating device 10 generates another addition value including random value, and the pattern of the hand-sewn taste is generated by different adjustment value.

Namely, the combination pattern is converted into the hand-sewn taste and ready to be sewn by the number of times the user presses the pattern button.

FIG. 2 illustrates the case where the user presses the pattern button 1 five times to form five cycles of the continuous pattern.

When the user moves the cursor by using the cursor button and presses the intensity change button, the intensity of fluctuation sequentially varies in the order of 100%, 75%, 50%, 0% (no fluctuation).

Namely, the user moves the cursor by using the cursor button to change the intensity of fluctuation while regarding the magnitude of the vector calculated from the addition value including random value which is stored for the selected pattern as 100%, 75%, 50% or 0%.

Note that the intensity of fluctuation is changed but the tendency of fluctuation is not changed in the above described case since the same addition value including random value is used.

In addition, when the user presses [+] and [−] buttons of the manual adjustment of the amplitude and the feeding, the vector value of the stored addition value including random value is applied after the width of the amplitude is adjusted or the length of the feeding is adjusted. Accordingly, the tendency of fluctuation is not changed.

When the user moves the cursor by using the cursor button to delete the pattern indicated by the cursor position by the delete button and insert the pattern into the cursor position, the coordinate data creating device 10 newly creates the addition value including random value and the pattern having different tendency of fluctuation is inserted.

In addition, the combination pattern of the hand-sewn taste can be stored in a file by using the save button.

Furthermore, in addition to the original pattern data, the generated addition value including random value and the intensity of the fluctuation can be stored in the external medium.

Accordingly, the state of the fluctuation can be redundantly created anytime by reading the stored data again.

<Process of Coordinate Data Creating Device>

Figure 3:
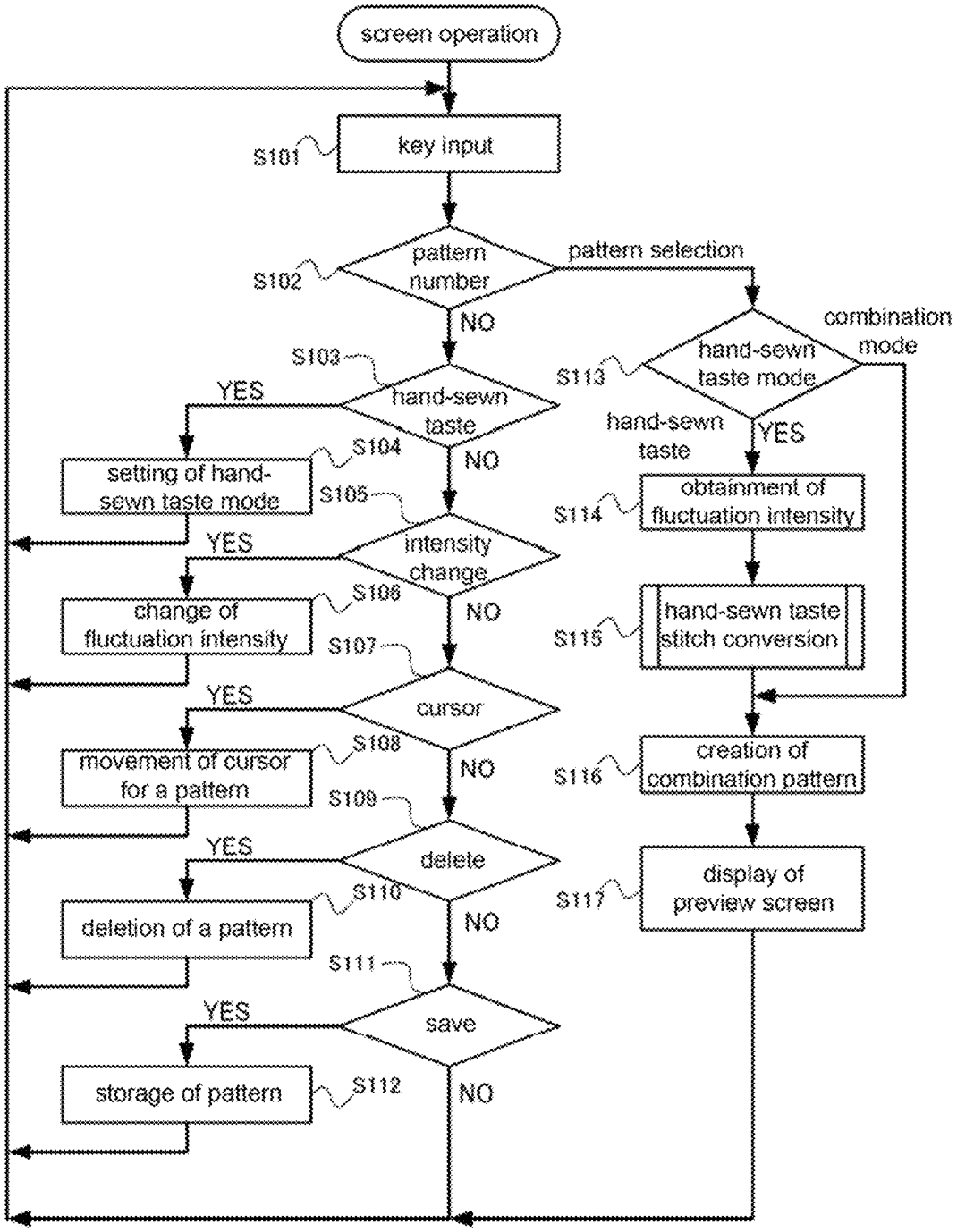
FIG. 3 is a processing flowchart for operating an operation screen in the coordinate data creating device concerning an embodiment of the present invention.
Figure 4:
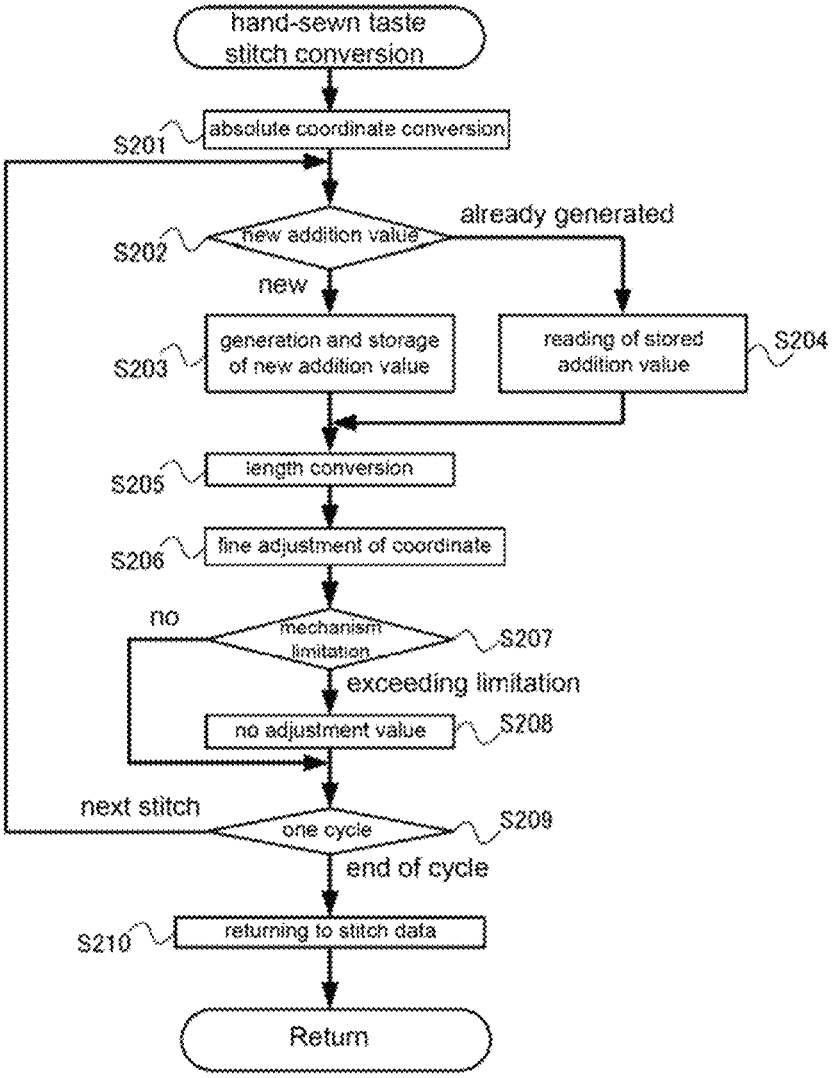
FIG. 4 is a processing flowchart related to a hand-sewn taste stitch conversion in the coordinate data creating device concerning an embodiment of the present invention.

The details of the screen operating process and the hand-sewn taste stitch conversion process in the coordinate data creating device 10 of the present embodiment will be explained by using FIG. 2 to FIG. 4.

<Screen Operating Process>

The creation of the sewing data using the coordinate data creating device 10 of the present embodiment is performed by operating the screen displayed on the liquid crystal display 105 shown in FIG. 2.

Accordingly, before explaining the detailed process of the coordinate data creating device 10, the details of the screen operating process in the coordinate data creating device 10 of the present invention will be explained using FIG. 2.

When the display mode for displaying the operation screen shown in FIG. 2 on the liquid crystal display 105 is selected by the user, the central processing unit (CPU) 101 of the coordinate data creating device 10 first shifts the mode to the waiting mode for waiting the pressing of operation button, cursor button, pattern button and the like by a key input of the user (Step S101).

Then, the central processing unit (CPU) 101 determines whether or not the pattern is selected by the user. Specifically, the central processing unit (CPU) 101 determines whether or not the pattern number is inputted (Step S102).

As a result of the determination, when the central processing unit (CPU) 101 determines that the pattern is selected by the user (i.e., the pattern number is inputted by the user, for example), then the central processing unit (CPU) 101 determines whether the process is the combination mode or the hand-sewn taste mode (Step S113).

In both of the process of the combination mode and the process of the hand-sewn taste mode, the process is performed and the pattern is stored in the selected order.

In Step S102, as a result of the determination, when the central processing unit (CPU) 101 determines that the pattern is not selected by the user (i.e., the pattern number is not inputted by the user, for example) ("No" in Step S102) and the hand-sewn taste button is pressed ("Yes" in Step S103), the mode is set to the hand-sewn taste mode and the process is returned to Step S101 (Step S104).

On the other hand, when the central processing unit (CPU) 101 determines that the hand-sewn taste button is not pressed by the user in Step S103 ("No" in Step S103), the central processing unit (CPU) 101 determines whether or not the intensity change button is pressed by the user (Step S105).

When the central processing unit (CPU) 101 determines that the intensity change button is pressed by the user in Step S105 ("Yes" in Step S105), the fluctuation intensity is changed and the process is returned to Step S101 (Step S106).

When the intensity change button is pressed, the intensity is cyclically switched in the order of 100%, 75%, 50%, no fluctuation and 100%.

On the other hand, when the central processing unit (CPU) 101 determines that the intensity change button is not pressed by the user in Step S105 ("No" in Step S105), the central processing unit (CPU) 101 determines whether or not the cursor button is pressed by the user (Step S107).

When the central processing unit (CPU) 101 determines that the cursor button is pressed by the user in Step S107 ("Yes" in Step S107), the cursor is moved forward or backward for a line of the pattern stored in the pattern selecting module and the process is returned to Step S101 (Step S108).

On the other hand, when the central processing unit (CPU) 101 determines that the cursor button is not pressed by the user in Step S107 ("No" in Step S107), the central processing unit (CPU) 101 determines whether or not the delete button is pressed by the user (Step S109).

When the central processing unit (CPU) 1011 determines that the delete button is pressed by the user in Step S109 ("Yes" in Step S109), the pattern indicated by the cursor position is deleted and the following patterns are moved forward and the process is returned to Step S101 (Step S110).

Note that the above described motions can be seen in the preview area of the liquid crystal display 105 shown in FIG. 2.

On the other hand, when the central processing unit (CPU) 101 determines that the delete button is not pressed by the user in Step S109 ("No" in Step S109), the central processing unit (CPU) 101 determines whether or not the save button is pressed by the user (Step S111).

When the central processing unit (CPU) 101 determines that the save button is pressed by the user in Step S111 ("Yes" in Step S111), the pattern converted into the hand-sewn taste and the combination pattern are stored in the external medium or the like so as to be used again and the process is returned to Step S101 (Step S112).

When the save button is pressed, the addition value including random value of each stitch used for converting the pattern into the hand-sewn taste and the information of the intensity of the fluctuation are also stored simultaneously with the pattern.

On the other hand, when the central processing unit (CPU) 101 determines that the save button is not pressed by the user in Step S111 ("No" in Step S111), the process is returned to Step S101.

When the central processing unit (CPU) 101 determines that the pattern button is pressed in the hand-sewn taste mode by the user in Step S113 ("Yes" in Step S113), the fluctuation intensity is obtained (Step S114) and the process is shifted to the hand-sewn taste stitch conversion process (Step S115).

Then, in the hand-sewn taste stitch conversion process, the process of adding the fluctuation to each of the needle location points is performed based on the obtained fluctuation intensity.

Note that the details of the hand-sewn taste stitch conversion process will be explained later.

On the other hand, when the central processing unit (CPU) 101 determines that the combination mode button is pressed by the user in Step S113 ("No" in Step S113) and the hand-sewn taste stitch conversion process in Step S115 is finished, the pattern data is combined similar to the combination of the normal pattern (Step S116).

Then, the central processing unit (CPU) 101 displays the preview screen on the liquid crystal display 105 in Step S117.

Consequently, the user can check the converted state.

Note that the editing operations such as deletion and addition are possible since the patterns converted by the hand-sewn taste mode are equally treated as the normal patterns. After the desired combination pattern is created, the sewing machine starts sawing when the start button of the tact switch 107 is pressed.

<Hand-Sewn Taste Stitch Conversion Process>

The details of the hand-sewn taste stitch conversion process will be explained by using FIG. 4.

The hand-sewn taste stitch conversion process is composed of "fluctuation process," "same coordinate process" and "combination editing process."

Hereafter, the outline of the above described processes will be explained by using FIG. 4 before the detailed explanation of the hand-sewn taste stitch conversion process.

<Fluctuation Process>

If the data of the feeding direction is still in the state of the relative moving amount, the coordinate of the needle location points cannot be adjusted.

Thus, in the fluctuation process, the stitch data indicated as the relative moving amount is once converted into the data string indicated as the absolute coordinate indicating the location of the needle location points.

Consequently, the absolute coordinate string of one cycle or a plurality of cycles of the orthogonal coordinate is generated.

When the addition value including random value is newly generated, the adjustment amount of ±1 mm or less, for example, for deviating the X-coordinate and the Y-coordinate of the needle location point is prepared for each of the needle location points.

Note that the addition value including random value is not necessarily generated as needed. A preliminarily generated adjustment data can be stored as a table format.

For example, the adjustment value adjusted by the addition value including random value generated in a range of ±1 mm is added to the data string indicating the needle location points as the absolute coordinate.

The adjusted coordinate data is limited so that the amplitude direction is within the width of the mechanism and limited so that the distance between the previous stitch and the current stitch in the feeding direction is equal to or less than a predetermined distance.

Then, the data string of the needle location points indicated as the absolute coordinate is converted into the relative moving amount in the feeding direction to convert the format into the stitch data format of the normal sewing.

Note that the width of the mechanism in the amplitude direction is 8.8 mm and the distance between the previous stitch and the current stitch in the feeding direction is limited to 5 mm as an example in the following explanation.

<Same Coordinate Process>

In a certain shape of the pattern, the stitch data passing through the same point several times is often created.

In this case, if the X-coordinate and the Y-coordinate of the needle location points are displaced without limitation for all of the needle location points, the original pattern shape is lost.

Therefore, when a plurality of needle location points are located at the same position, the positions are controlled so that the above described needle location points are located at the same position even after the conversion process.

<Combination Editing Process>

The needle location points of the X-coordinate and the Y-coordinate are dispersed by using the addition value including random value which is different in each cycle of the pattern and a plurality of patterns are combined.

The user presses the pattern button on the operation screen shown in FIG. 2 for storing the combined content.

The addition value including random value is newly generated by the above described pattern selection operation. Thus, a plurality of combination patterns is created from the same original pattern by displacing the X-coordinate and the Y-coordinate of the needle location points in different ways each time when the pattern is selected.

The user previews an appearance of the converted stitch data, and adopts the pattern generated by a preferable displacement of the X-coordinate and the Y-coordinate of the needle location points.

If the user thinks that the previewed pattern is not generated by a preferable displacement of the X-coordinate and the Y-coordinate of the needle location points, it is possible to delete the pattern and edit the combination pattern on the screen.

In addition, the user can displace the X-coordinate and the Y-coordinate of the needle location points by using the addition value including random value, while the user can also displace the X-coordinate and the Y-coordinate of the needle location points by using the table.

<Details of Process of Hand-Sewn Taste Stitch Conversion>

In order to perform the corresponding process, the user presses "hand-sewn taste" button on the operation screen displayed on the liquid crystal display 105 shown in FIG. 2 to select the combination mode of the hand-sewn taste.

Then, the user presses the pattern selection button to select the pattern.

First, the central processing unit (CPU) 101 of the coordinate data creating device 10 converts the stitch data (the feeding direction is indicated as the relative moving amount) of the pattern selected by the user into the data string indicated as the absolute coordinate by an accumulation process of the relative feeding amount (Step S201).

The central processing unit (CPU) 101 determines whether or not the addition value including random value corresponding to the pattern is stored in the addition value memory 103C which functions as the addition value storage unit (Step S202).

As a result of the determination, when the central processing unit (CPU) 101 determines that the addition value including random value is not stored in the addition value memory 103C (i.e., addition value storage unit), the process is shifted to Step S203. In Step S203, the central processing unit (CPU) 101 newly generates two addition values including random value for the amplitude and feeding and stores the generated addition values including random value in the addition value memory 103C (i.e., addition value storage unit). Then, the process is shifted to Step S205.

On the other hand, as a result of the determination, when the central processing unit (CPU) 101 determines that the addition value including random value is stored in the addition value memory 103C (i.e., addition value storage unit), the process is shifted to Step S204. In Step S204, the central processing unit (CPU) 101 reads the stored addition value including random value. Then, the process is shifted to Step S205.

Since the addition values including random value obtained in Step S203 and Step S204 are integers, the central processing unit (CPU) 101 starts the adjustment value generating module and converts the addition values including random value into the adjustment length within the range of ±1.0 mm (Step S205).

The central processing unit (CPU) 101 starts the adjustment value adding module and adds the adjustment length converted in Step S205 to the coordinates of the amplitude direction and the feeding direction for finely adjusting the coordinates (Step S206).

However, since the coordinates cannot be finely adjusted exceeding the limit value of the mechanism, the central processing unit (CPU) 101 starts the mechanism limitation limiting module to determine whether or not the value of the Y-coordinate of the finely adjusted coordinate data is within the limitation of the mechanism or the distance between the value of the X-coordinate of the finely adjusted coordinate data and the value of the X-coordinate of the neighboring finely adjusted coordinate data in the sewing order is within the limitation of the mechanism (Step S207).

Here, when the value of Y-coordinate of the finely adjusted coordinate data exceeds the limitation of the mechanism in the amplitude (Y-coordinate) direction, the finely adjusted process in Step S206 is invalidated (Step S208).

In addition, when the distance between the value of the X-coordinate of the finely adjusted coordinate data and the value of the X-coordinate of the neighboring finely adjusted coordinate data exceeds the limitation of the mechanism in the feeding (X-coordinate) direction, the finely adjusted process in Step S206 is invalidated (Step S208).

Here, the value of the limitation of the mechanism in the amplitude direction can be −4.4 mm or +4.4 mm, for example, and the value of the limitation of the mechanism in the feeding direction can be −5.0 mm or +5.0 mm as the relative moving amount, for example.

Although the above described explanation is related to the limitation in the normal sewing, the finely adjusted process in Step S206 is invalidated (Step S208) even in the embroidery sewing when the distance between the value of the finely adjusted coordinate data and the value of the neighboring finely adjusted coordinate data exceeds the limitation of the mechanism in the X-coordinate direction or the Y-coordinate direction.

On the other hand, when the finely adjusted coordinates in the amplitude direction and the feeding direction do not exceed the limitation of the mechanism, the process is shifted to Step S209.

The central processing unit (CPU) 101 determines whether or not one cycle of the stitch is finished (Step S209).

When the central processing unit (CPU) 101 determines that the stitch still remains, the process is returned to Step S202.

In this case, the central processing unit (CPU) 101 generates a new addition value including random value for the next needle location point and Steps S203, S205 are performed.

On the other hand, when the central processing unit (CPU) 101 determines that one cycle is finished (Step S209), the feeding data indicated as the absolute coordinate by the finely adjusted process is converted into the relative moving amount to return to the original format of the stitch data (Step S210).

First Example

Hereafter, the first example of the present invention will be explained with reference to FIG. 5 to FIG. 9.

Figure 5:
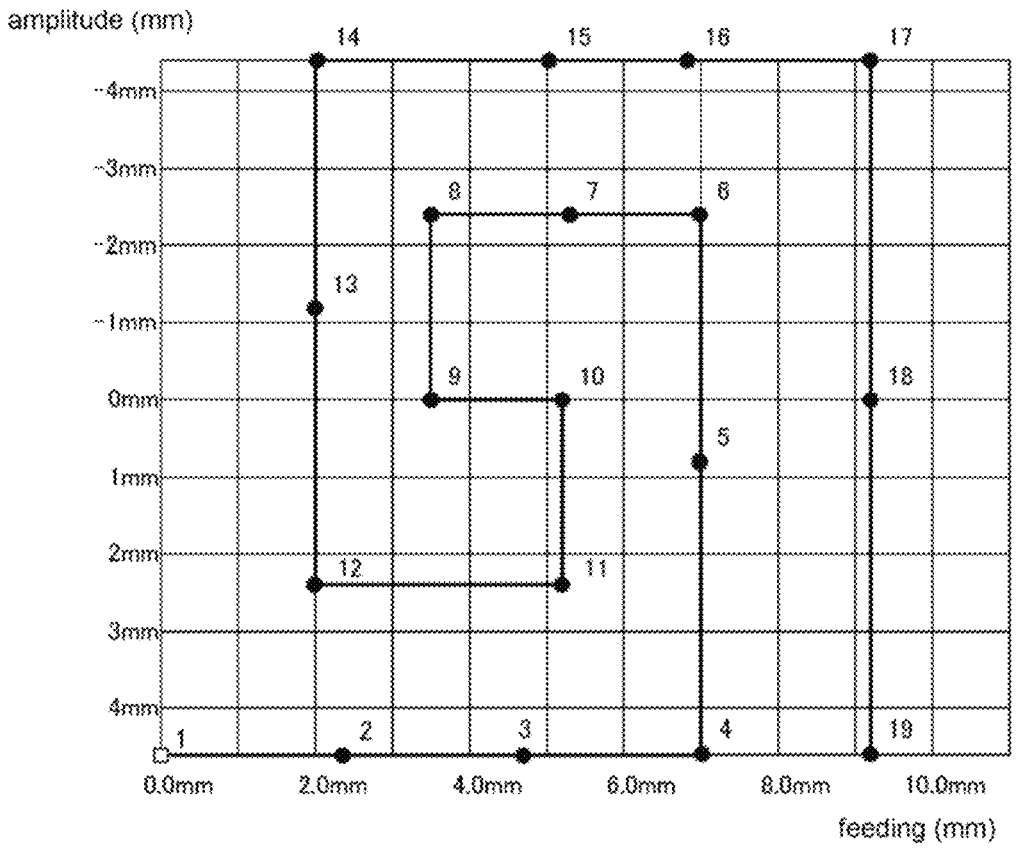
FIG. 5 is a drawing illustrating a display of needle location points in a simple stitch concerning the first example of the present invention.

In the present example, as shown in FIG. 5, the sewing data of the normal sewing is composed of the coordinate data of the amplitude position within a range of −4.4 mm to +4.4 mm for swinging the needle bar in the left and right directions and the data of the relative moving amount within a range of −5.0 mm to +5.0 mm for feeding the cloth in the front and back directions by feeding teeth when the transverse direction is defined as the feeding direction, the longitudinal direction is defined as the amplitude direction and the center of the amplitude direction is defined as 0.0 mm.

In addition, the relation between the amplitude and the relative feeding of the original data is shown in FIG. 6.

FIG. 6 shows the original data including the amplitude and the relative feeding as elements, the absolute feeding obtained by accumulating the relative feeding, examples of the adjustment length of the addition value for the amplitude and the feeding, and examples of the amplitude, the absolute feeding and the relative feeding after the hand-sewn process for adding strong fluctuation to the original data.

In FIG. 6, the adjustment length of the addition value is the value obtained by rounding to the first decimal place.

Specifically, the adjustment length of the addition value for the second stitch of the amplitude is 0.1 which exceeds the mechanism limitation. Thus, the value of 0.1 is canceled and the value of 4.4 which is the value of original data is continually used as the value of the amplitude after the second hand-sewn process is applied.

Furthermore, the value of the absolute feeding after the hand-sewn process for the second stitch becomes 2.7 since the value of the absolute feeding of the original data is 2.3 and the adjustment amount of the addition value is 0.4.

Furthermore, the value of the relative feeding after the hand-sewn process for the second stitch becomes 1.8 since the value of the absolute feeding after the hand-sewn process for the second stitch is 2.7 and the value of the absolute feeding after the hand-sewn process for the third stitch is 4.5.

Furthermore, the value of the amplitude after the hand-sewn process for the fifth stitch becomes 1.0 since the value of the original data is 0.8 and the adjustment amount of the addition value of the amplitude is 0.2.

Furthermore, the value of the absolute feeding after the hand-sewn process for the fifth stitch becomes 7.2 since the value of the original data is 7.0 and the adjustment amount of the addition value of the feeding is 0.2.

Furthermore, the value of the relative feeding after the hand-sewn process for the fifth stitch becomes −0.5 since the value of the absolute feeding after the hand-sewn process for the sixth stitch is 6.7 and the value of the absolute feeding after the hand-sewn process for the fifth stitch is 7.2.

Hereafter, the contents of the detailed process will be explained according to the concrete example shown in FIG. 6.

In the present example, the cloth is moved by the feeding teeth for each stitch to form the unit pattern having a size of several millimeters to several tens millimeters.

When the sewing of the unit pattern is continuously repeated, a long pattern formed by a plurality of cycles can be sewn.

One cycle of the pattern can be expressed by the data string of the absolute coordinate shown in FIG. 6 by accumulating the feeding data indicated as the relative distance.

The coordinates of the amplitude and the absolute feeding of the original data shown in FIG. 6 indicate the coordinates of the needle location points shown in FIG. 5.

In the present example, in order to show the appearance of the hand-sewn taste, the X-coordinate and the Y-coordinate of each needle location point are finely adjusted by using the numerical value of the addition value including random value.

Accordingly, the addition values including random value are generated both for the adjustment value for adjusting the amplitude direction and the adjustment value for adjusting the feeding direction are generated in each needle position.

Here, the random value to be used is an integer having the value of 0 to 32767, and the numerical value is converted into the value of −1.0 mm to +1.0 mm as the adjustment value of the length.

For example, the value is converted by using Mathematical 1 shown below.

$$\text{adjust}=((\text{random}\ \%21)-10)/10[\text{mm}] \qquad \text{[Mathematical 1]}$$

adjust: adjustment value, random: addition value including random value, %: remainder calculation In the above described example, the adjustment value of −1.0 mm to +1.0 mm can be created with 0.1 millimeter unit by dividing the addition value including random value (random) by 21, subtracting 10 from the remainder of the above described division, and dividing the result of the above described subtraction by 10.

In addition, the addition values including random value generated for the amplitude and the feeding of each needle location point and converted into the adjustment length by using Table 1 are shown in the columns of "for amplitude" and "for feeding" of "adjustment length of addition value" shown in FIG. 6 as an example.

The coordinates are adjusted by adding the above described adjustment values to the coordinates of "amplitude" and "absolute feeding" of "original data."

However, when the added result exceeds the limit value of the mechanism (shaded area in FIG. 6), the adjustment is invalidated and the value is not added.

The adjustment result is shown in "amplitude" and "absolute feeding" of "hand-sewn process" shown in FIG. 6 as an example.

Furthermore, when the relative feeding amount is calculated from the absolute feeding and registered in a list format as shown in FIG. 6, the data string of "amplitude" and "relative feeding" of "hand-sewn process" becomes the pattern data of the normal sewing.

When the repeatability of the hand-sewn taste pattern is emphasized, dispersed numerical values can be stored in a table instead of the addition values including random value.

Figure 7:
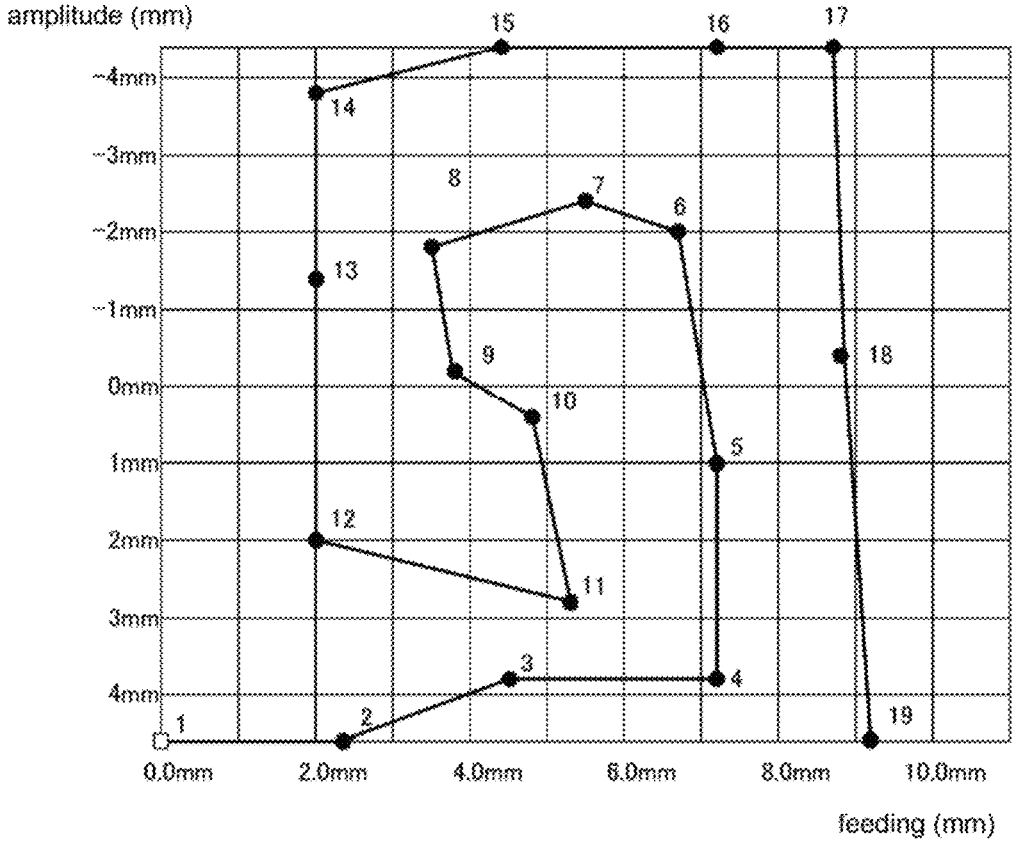
FIG. 7 is a drawing illustrating the sewing image of a hand-sewn taste stitch when strong fluctuation is added to the sawn image shown in FIG. 5 in a simple stitch concerning the first example of the present invention.

FIG. 5 shows the stitch pattern of the normal sewing, and FIG. 7 shows the stitch pattern after the process of adding strong fluctuation.

FIG. 6 and FIG. 7 show an example of newly generating the addition values including random value, converting them into the vectors of ±1.0 mm, and adding the vectors to each needle location point with the intensity of 100%. Since the strong fluctuation is added in the above described example, the needle location points are displaced significantly from the original needle location points in some points.

FIG. 8 shows the original data including the amplitude and the relative feeding as elements, the absolute feeding obtained by accumulating the relative feeding, examples of the adjustment length of the addition value for the amplitude and the feeding, and examples of the amplitude, the absolute feeding and the relative feeding after the hand-sewn process for adding weak fluctuation to the original data.

Specifically, the adjustment length of the addition value for the second stitch of the amplitude is 0.1 which exceeds the mechanism limitation. Thus, the value of 0.1 is canceled and the value of 4.4 which is the value of original data is continuously used as the value of the amplitude after the second hand-sewn process is applied.

Furthermore, the value of the absolute feeding after the hand-sewn process for the second stitch becomes 2.5 since the value of the absolute feeding of the original data is 2.3 and the adjustment amount of the addition value of the feeding is 0.2.

Furthermore, the value of the relative feeding after the hand-sewn process for the second stitch becomes 2.1 since the value of the absolute feeding after the hand-sewn process for the second stitch is 2.5 and the value of the absolute feeding after the hand-sewn process for the third stitch is 4.6.

Furthermore, the value of the amplitude after the hand-sewn process for the fifth stitch becomes 0.9 since the value of the original data is 0.8 and the adjustment amount of the addition value of the amplitude is 0.1.

Furthermore, the value of the absolute feeding after the hand-sewn process for the fifth stitch becomes 7.1 since the value of the original data is 7.0 and the adjustment amount of the addition value of the feeding is 0.1.

Furthermore, the value of the relative feeding after the hand-sewn process for the fifth stitch becomes −0.3 since the value of the absolute feeding after the hand-sewn process for the sixth stitch is 6.8 and the value of the absolute feeding after the hand-sewn process for the fifth stitch is 7.1.

Figure 9:
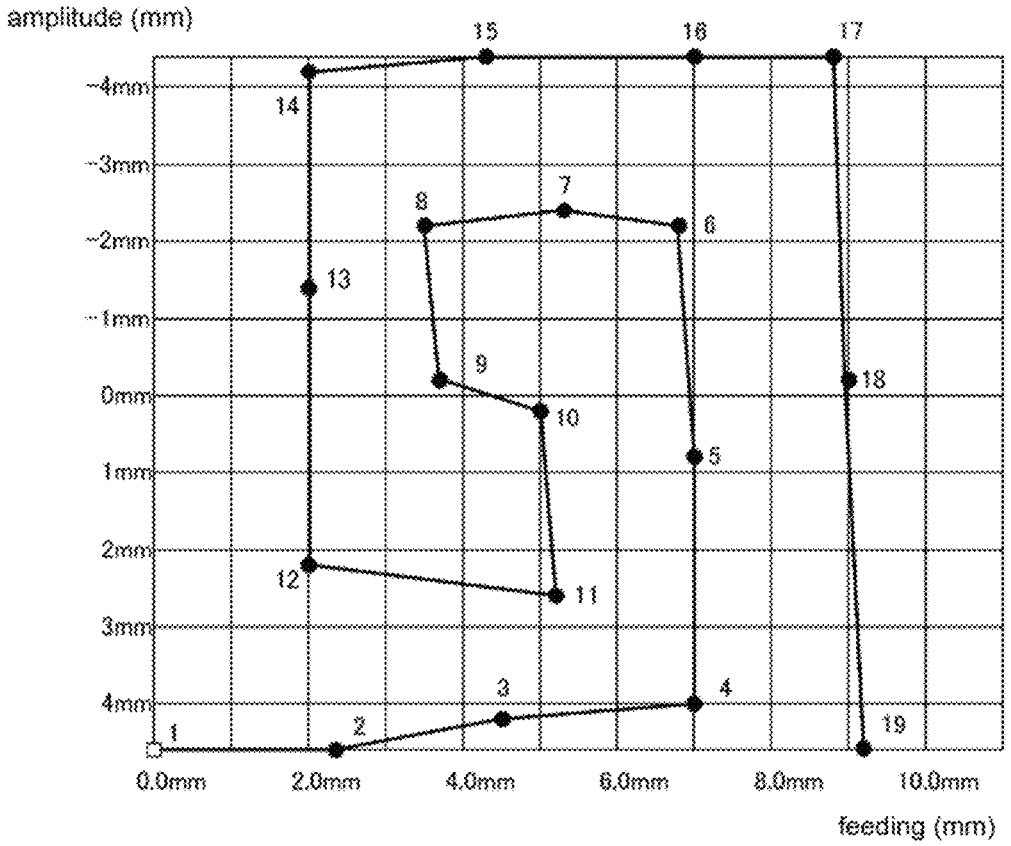
FIG. 9 is a drawing illustrating the sewing image of a hand-sewn taste stitch when weak fluctuation is added to the sawn image shown in FIG. 5 in a simple stitch concerning the first example of the present invention.
Figure 10:
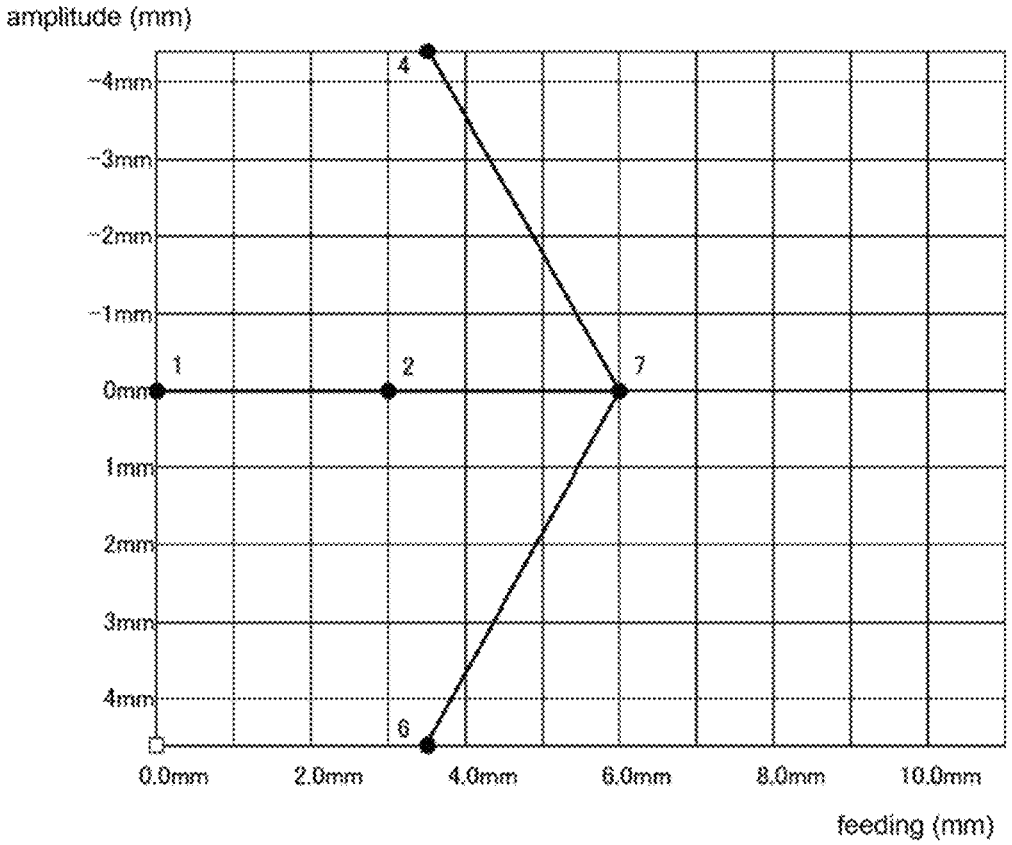
FIG. 10 is a drawing illustrating a display of needle location points in a simple stitch concerning the second example of the present invention.

FIG. 5 shows the stitch pattern of the normal sewing, and FIG. 9 shows the stitch pattern after the process of adding weak fluctuation.

About the adjustment values (−1.0 mm to +1.0 mm) converted based on the addition value including random value, if vector values are considered while the feeding direction is regarded as an X-element and the amplitude direction is regarded a Y-element, the needle location points are slightly displaced when the vector element generated from the addition value including random value is added to the original needle location coordinate.

When the vector element generated from the addition value including random value is added to all of the needle location points, different impression is given even if the patterns are originally same. In addition, even when a plurality of same patterns is selected and combined, since different addition value including random value is generated for each stitch, all combination patterns are combined while giving different impression with each other.

FIG. 8 and FIG. 9 show an example that the addition value including random value generated in FIG. 2 is stored in the addition value memory 103C which functions as the addition value storage unit shown in FIG. 1 and the fluctuation is added to each needle location points by using the stored addition value including random value while weakening the intensity to 50%. It can be understood that the tendency of the fluctuation of the pattern shown in FIG. 9 is same as that of FIG. 7 but only the intensity is weakened. In FIG. 8, the adjustment length of the addition value is the value obtained by rounding to the first decimal place.

If the addition value including random value is newly generated when the intensity of the fluctuation is changed or the amplitude and the feeding are adjusted, (i.e., the operation of the adjustment and the like is performed after the desired fluctuation is obtained), the fluctuation may be also changed and separated from the desire of the user. Accordingly, the generated addition value including random value is stored and whether the stored addition value including random value is used again or the addition value including random value is newly generated is determined according to the operation of the user.

Second Example

Hereafter, the second example of the present invention will be explained with reference to FIG. 10 to FIG. 16.

As shown in FIG. 11 (transverse direction is feeding direction, longitudinal direction is amplitude direction), the sewing data of the normal sewing is composed of the coordinate data of the amplitude position within a range of −4.4 mm to +4.4 mm for swinging the needle bar in the left and right directions and the coordinate data of the relative moving amount within a range of −5.0 mm to +5.0 mm for feeding the cloth in the front and back directions by feeding teeth. In FIG. 11, the adjustment length of the addition value is the value obtained by rounding to the first decimal place.

In the stitch list shown in FIG. 11, the value is expressed as "amplitude" and "feeding." The cloth is moved by the feeding teeth for each stitch to form the unit pattern having a size of several millimeters to several tens millimeters. When the sewing of the unit pattern is continuously repeated, a long pattern formed by a plurality of cycles can be sewn. One cycle of the pattern can be expressed by the data string of the absolute coordinate shown in "amplitude" and "feeding" of the list of FIG. 11 by accumulating the feeding data indicated as the relative distance.

Figure 12:
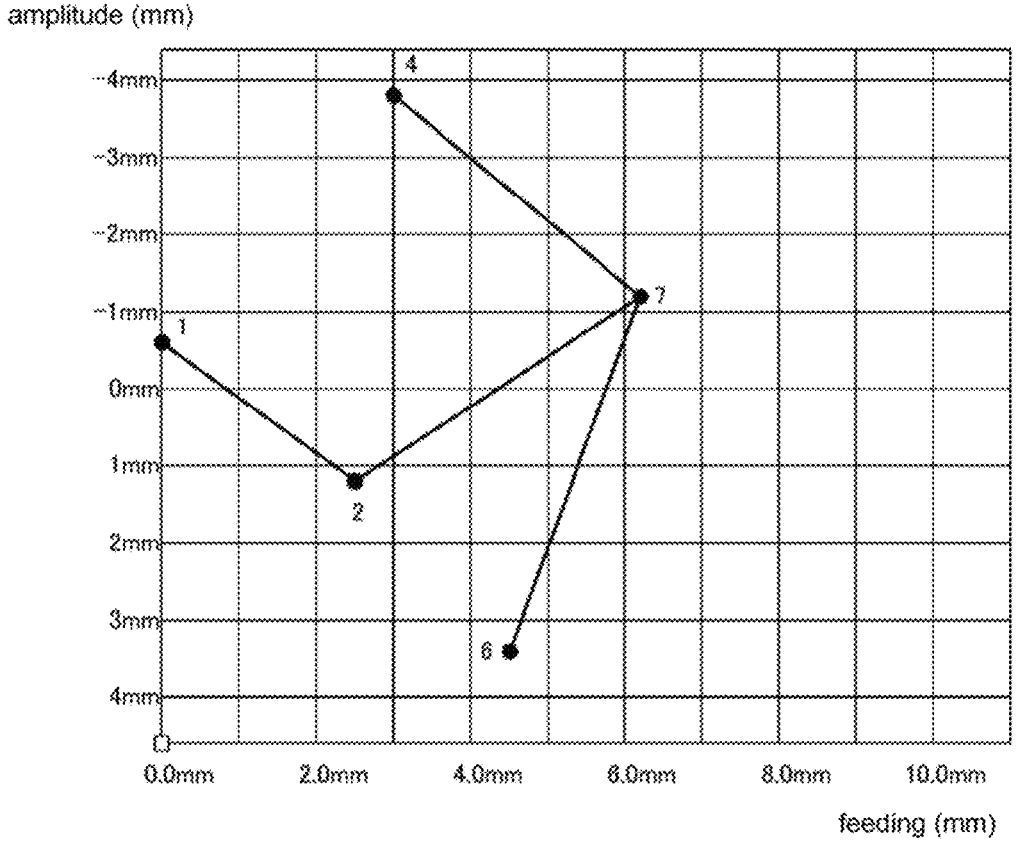
FIG. 12 is a drawing illustrating the sewing image of a hand-sewn taste stitch when strong fluctuation is added to the sawn image shown in FIG. 10 in a simple stitch concerning the second example of the present invention.

As shown in FIG. 11, when the strong fluctuation is added to the normal sewing by using the addition value including random value with the intensity of 100%, the pattern is converted into the state shown in FIG. 12.

Figure 13:
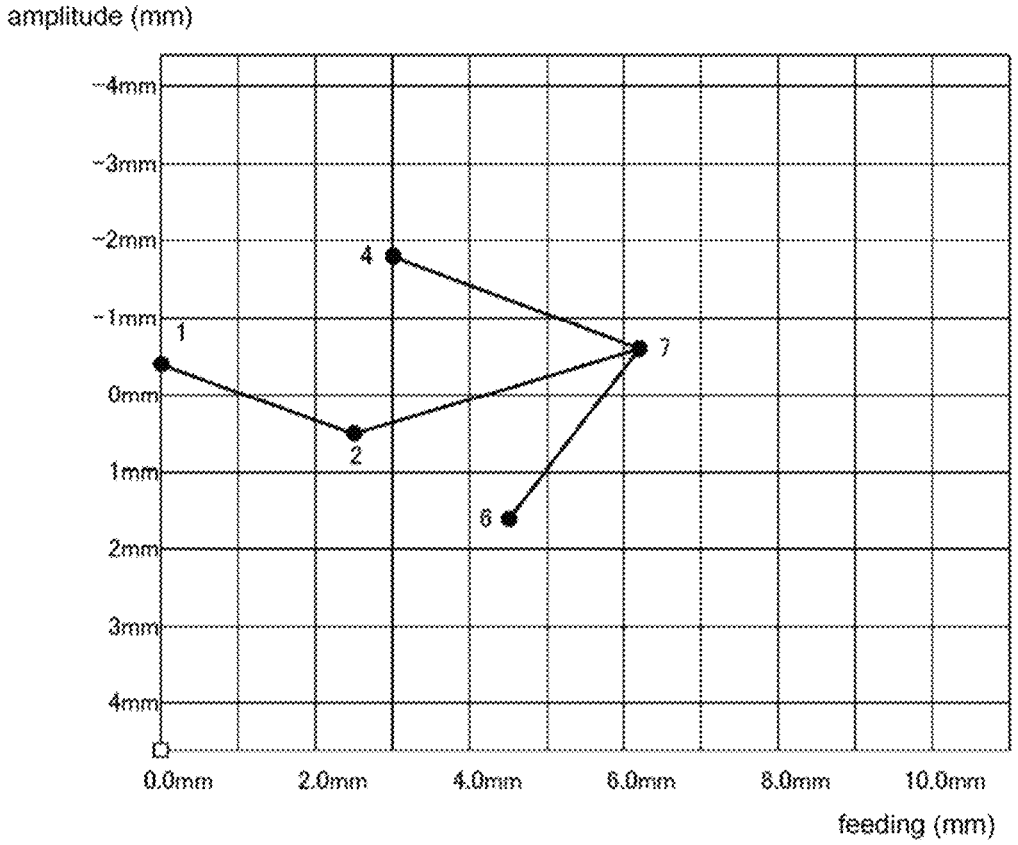
FIG. 13 is a drawing illustrating the sewing image of a hand-sewn taste stitch when the amplitude is changed in the sawn image shown in FIG. 12 in a simple stitch concerning the second example of the present invention.

In addition, FIG. 14 shows the stitch data and FIG. 13 shows the pattern when the amplitude value of the stitch data is changed to a half (i.e., the amplitude value is changed from 8.8 to 4.4) after the amendment is applied to the stitch list (amplitude: 8.8) shown in FIG. 11 by using the addition value including random value. In FIG. 14, the adjustment length of the addition value is the value obtained by rounding to the first decimal place.

As can be seen from FIG. 13, when the amplitude value of the stitch data is changed to a half after the amendment using the addition value including random value is applied, the addition value including random value is reduced in accordance with the change of the amplitude value.

Figures 15, 16:
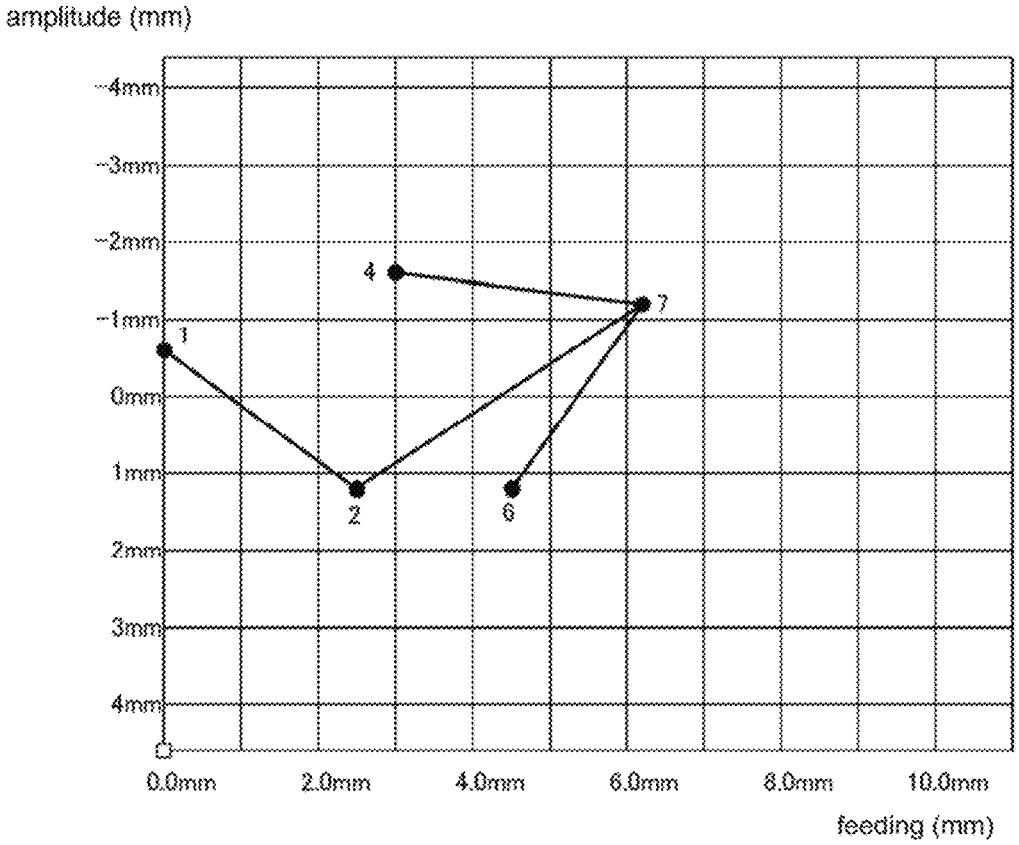
FIG. 15 is a drawing illustrating the sewing image of a hand-sewn taste stitch when the amplitude is changed and the fluctuation is added in the sawn image shown in FIG. 10 in a simple stitch concerning the second example of the present invention.
FIG. 16 is a drawing illustrating an original data and an addition value when the amplitude is changed and the fluctuation is added in the sawn image shown in FIG. 10 in a simple stitch concerning the second example of the present invention.

In addition, FIG. 16 shows the stitch data and FIG. 15 shows the pattern when the addition value including random value is reflected after the amplitude value is changed to a half (i.e., the amplitude value is changed from 8.8 to 4.4) for the stitch list (amplitude: 8.8) shown in FIG. 11. In FIG. 16, the adjustment length of the addition value is the value obtained by rounding to the first decimal place.

As can be seen from FIG. 15, when the addition value including random value is reflected after the amplitude value of is changed to a half, the addition value including random value is reflected without being influenced by the change of the amplitude value.

As explained above, the coordinate data creating device 10 of the present embodiments and the present examples includes: a coordinate data storage unit 103B for storing coordinate data which indicates a needle location of a pattern to be sewn; an addition value storage unit (addition value memory (RAM)) 103C for storing an addition value which is added to each of the coordinate data; an adjustment unit (e.g., adjustment value generating module shown in FIG. 1) for adjusting the coordinate data or the addition value; and an added coordinate data creating unit (e.g., adjustment value adding module shown in FIG. 1) for creating a new coordinate data where the pattern is deformed (i.e., modified, collapsed) by adding the addition value adjusted by the adjustment unit to the coordinate data or by adding the addition value to the coordinate data adjusted by the adjustment unit or by adding the addition value adjusted by adjustment unit to the coordinate data adjusted by the adjustment unit.

Here, the coordinate data storage unit 103B stores the coordinate data which indicates the needle location of the pattern to be sewn. The addition value storage unit (addition value memory (RANI)) 103C stores the addition value which is added to each of the coordinate data. The adjustment unit (e.g., adjustment value generating module shown in FIG. 1) adjusts the coordinate data or the addition value. The added coordinate data creating unit (e.g., adjustment value adding module shown in FIG. 1) creates a new coordinate data where the pattern is deformed by adding the addition value adjusted by the adjustment unit to the coordinate data or by adding the addition value to the coordinate data adjusted by the adjustment unit or by adding the addition value adjusted by adjustment unit to the coordinate data adjusted by the adjustment unit.

Namely, the adjustment unit (e.g., adjustment value generating module shown in FIG. 1) has a function of adjusting the coordinate data stored in the coordinate data storage unit 103B or the addition value stored in the coordinate data storage unit 103B and the added coordinate data creating unit (e.g., adjustment value adding module shown in FIG. 1) has a function of creating a new coordinate data where the pattern is deformed by adding the addition value adjusted by the adjustment unit to the value of the X-coordinate or the Y-coordinate of the coordinate data or by adding the addition value to the coordinate data adjusted by the adjustment unit or by adding the addition value adjusted by adjustment unit to the coordinate data adjusted by the adjustment unit.

Accordingly, hand-sewn taste is created in the sewing pattern by adding an appropriate fluctuation for each stitch and the desired seam can be formed without changing the tendency of the hand-sewn taste for the same pattern.

In addition, when the pattern is newly selected, a new addition value including random value is generated and different fluctuation is added to the pattern. When the intensity or the amplitude/feeding of the fluctuation is finely adjusted, the fluctuation can be converted within the same tendency since the previously used addition value including random value is used.

Note that the coordinate data includes both the coordinate data of the normal sewing and the coordinate data of the embroidery sewing.

In addition, the process of adding independent values which are independent from each other to the value of the X-coordinate or the value of the Y-coordinate of the coordinate data is the process of adding the independent values to the coordinate data and X-coordinate and the value of the Y-coordinate respectively. Thus, when considering the case where one of the independent values is zero, the process can include the case where the independent value is added only to one of X-coordinate or the Y-coordinate of the coordinate data, for example.

In addition, the coordinate data creating device 10 of the present embodiments and the present examples includes an adjusted data storage unit 103*b* for storing the coordinate data or the addition value adjusted by the adjustment unit (e.g., adjustment value generating module shown in FIG. 1).

Namely, the adjusted data storage unit 103*b* stores the coordinate data or the addition value adjusted by the adjustment unit (e.g., adjustment value generating module shown in FIG. 1).

Accordingly, when the user wants to create the same hand-sewn taste for the same pattern which is same as the pattern sewn in the past, for example, the sewing is performed by reading the coordinate data or the addition value adjusted by the adjustment unit and stored in the adjusted data storage unit. Thus, the user can easily create the same hand-sewn taste for the same pattern which is same as the pattern sewn in the past.

In addition, in the coordinate data creating device 10 of the present embodiments and the present examples, the coordinate data has an amplitude direction value and a feeding direction value, and when the amplitude direction value or the feeding direction value of the new coordinate data exceeds a predetermined range, the amplitude direction value exceeding the predetermined range or the feeding direction value exceeding the predetermined range is not employed as the new coordinate data.

Namely, the coordinate data has the amplitude direction value and the feeding direction value. When the amplitude direction value or the feeding direction value of the new coordinate data exceeds a predetermined range (e.g., when the amplitude direction value or the feeding direction value of the new coordinate data the sewing machine exceeds the limit range of the mechanism), the limit range of the mechanism of the sewing machine is strictly observed since the limit range is an absolute restriction. Thus, when the amplitude direction value or the feeding direction value exceeds the limit range of the mechanism of the sewing machine, the amplitude direction value or the feeding direction value exceeding the predetermined range is not employed.

Accordingly, the pattern having a hand-sewn taste can be sewn while the original shape of the pattern is maintained and the limit range (i.e., absolute restriction) of the mechanism of the sewing machine is strictly observed.

Here, the process of "the value exceeding the predetermined range is not employed as the new coordinate data" includes the case where the value exceeding the predetermined range is not employed as the new coordinate data as literally interpreted and also includes the following cases, for example. When the predetermined range is "10," the addition process is not performed at all for the amplitude direction value or the feeding direction value of the coordinate data, the value not exceeding the predetermined range "10" is added to the amplitude direction value or the feeding direction value of the coordinate data, or the addition process is performed for the amplitude direction value or the feeding direction value of the coordinate data so that the value after the addition does not exceed the predetermined range "10."

In addition, when the same coordinate data exists in the sewing data having the sewing order and the coordinate data related to the sewing order, the independent values added respectively to the value of the X-coordinate and the value of the Y-coordinate of the same coordinate data are same as the values which are added to the value of the X-coordinate and the value of the Y-coordinate of the same coordinate data of the other sewing orders.

Namely, when the same coordinate data exists in the sewing data having the sewing order and the coordinate data related to the sewing order, the same values are added to the value of the X-coordinate or the value of the Y-coordinate of the coordinate data respectively.

Accordingly, the pattern can be deformed to have a hand-sewn taste while maintaining the original shape.

In addition, even when the sewing order is different, the displacement of the same point can be prevented by adding the same value if the coordinate data is same. Furthermore, the displacement can be prevented at the overlapped portion of the different patterns.

In addition, the independent value added to the value of the X-coordinate or the value of the Y-coordinate of the coordinate data can be made different depending on the pattern.

Namely, the independent value to be added can be made different even when the coordinate data is same if the pattern is different.

Accordingly, a plurality of sewing data can be formed in accordance with the pattern by adding independent values which are different in accordance with the pattern to the value of the X-coordinate or the value of the Y-coordinate of the coordinate data.

In addition, since a plurality of sewing data can be formed in accordance with the pattern, the selection range of the pattern preferred by the user can be broadened.

In addition, the coordinate data creating device can include an added pattern displaying unit for displaying the pattern of the new coordinate data created by the added coordinate data creating unit; and a coordinate data processing unit for storing or editing the coordinate data of each of the pattern displayed on the added pattern displaying unit.

Namely, when the added pattern displaying unit for displaying the pattern of the new coordinate data created by the added coordinate data creating unit is provided, the user can evaluate the perfection of the pattern while viewing the pattern of the new coordinate data.

In addition, when the coordinate data processing unit for storing or editing the coordinate data of each of the pattern displayed on the added pattern displaying unit is provided, the coordinate data of the pattern preferred by the user can be stored while viewing the new coordinate data displayed on the added pattern displaying unit.

On the other hand, when the pattern of the new coordinate data displayed on the added pattern displaying unit is different from the preference of the user, the user can edit (e.g., delete, move and modify) the coordinate data to find the pattern preferred by the user and the coordinate data of the preferred pattern can be stored.

In addition, the independent values added respectively to the value of the X-coordinate or the value of the Y-coordinate of the coordinate data are the addition value including random value within a predetermined range.

Namely, when the addition value including random value within a predetermined range is used for the independent values added to the value of the X-coordinate or the value of the Y-coordinate of the coordinate data, a plurality of pattern having no regularity can be created.

In addition, arbitrary value is a value within an arbitrary ratio with respect to the length in the component direction of the pattern.

Specifically, since a plurality of patterns having no regularity can be created, the range of selecting the pattern preferred by the user can be broadened.

In addition, the independent values added respectively to the value of the X-coordinate or the value of the Y-coordinate of the coordinate data are a positive value or a negative value within a predetermined range.

Accordingly, the pattern having a hand-sewn taste can be sewn while the original shape of the pattern is maintained.

In addition, the distance between the value of the X-coordinate of the coordinate data created by the added coordinate data creating unit and the value of the X-coordinate of the neighboring coordinate data created by the added coordinate data creating unit in the sewing order is the value within the limit range of the mechanism.

Note that the coordinate data creating device of the present invention can be achieved by recording the processes of the coordinate data creating device on a computer system or a computer readable recording medium and reading and executing the program recorded in the recording medium by the coordinate data creating device. Here, the computer system or the computer includes hardware such as an OS (operating system) and a peripheral device.

When the WWW (World Wide Web) system is used, "the computer system or the computer" includes a providing environment (or display environment) of the webpage. The program can be transferred from the computer system or the computer which stores the program in the storage unit or the like to other computer systems or computers via a transmission media or via transmission waves in the transmission media. Here, "the transmission media" for transmitting the program is the media having a function of transmitting information. For example, "the transmission media" is a network (communication network) such as Internet and a communication line (communication wire) such as telephone wire.

It is also possible to achieve only a part of the above described functions by the program. It is also possible to achieve the above described functions by combining the above described program with the programs already stored in the computer system or the computer. Namely, the program can be so-called a difference file (difference program).

Although the embodiments of the present invention are explained above with reference to drawings, the specific configuration is not limited to the above described embodiments. The specification can be changed within a range being not deviated from the subject-matter of the present invention.

For example, the coordinate data creating device can be a separately provided device such as a personal computer and a device included in the sewing machine or the like.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the sprit and scope of the invention as defined in the appended claims.

What is claimed is:

1. A coordinate data creating device, comprising:

a coordinate data storage unit for storing coordinate data which indicates a needle location of a pattern to be sewn;

an addition value storage unit for storing an addition value which is added to each of the coordinate data;

an adjustment unit for adjusting the coordinate data or the addition value; and an added coordinate data creating unit for creating a new coordinate data where the pattern is deformed by adding the addition value adjusted by the adjustment unit to the coordinate data or by adding the addition value to the coordinate data adjusted by the adjustment unit or by adding the addition value adjusted by adjustment unit to the coordinate data adjusted by the adjustment unit.

2. The coordinate data creating device according to claim 1, further comprising:

an adjusted data storage unit for storing the coordinate data or the addition data adjusted by the adjustment unit.

3. The coordinate data creating device according to claim 1, wherein the coordinate data has an amplitude direction value and a feeding direction value, and when the amplitude direction value or the feeding direction value of the new coordinate data exceeds a predetermined range, the amplitude direction value exceeding the predetermined range or the feeding direction value exceeding the predetermined range is not employed as the new coordinate data.

4. A sewing machine, comprising:

a coordinate data storage unit for storing coordinate data which indicates a needle location of a pattern to be sewn;

an addition value storage unit for storing an addition value which is added to each of the coordinate data;

an adjustment unit for adjusting the coordinate data or the addition value; and an added coordinate data creating unit for creating a new coordinate data where the pattern is deformed by adding the addition value adjusted by the adjustment unit to the coordinate data or by adding the addition value to the coordinate data adjusted by the adjustment unit or by adding the addition value adjusted by adjustment unit to the coordinate data adjusted by the adjustment unit, wherein the sewing machine performs a sewing based on the new coordinate data created by the added coordinate data creating unit.

* * * * *